US011155094B2

(12) United States Patent
Choy

(10) Patent No.: US 11,155,094 B2
(45) Date of Patent: Oct. 26, 2021

(54) ROTATABLE SERVICE ASSEMBLY FOR FLUID EJECTION DIE

(71) Applicant: HEWLETT-PACKARD DEVELOPMENT COMPANY, L.P., Spring, TX (US)

(72) Inventor: Si-lam Choy, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/630,049

(22) PCT Filed: Sep. 14, 2017

(86) PCT No.: PCT/US2017/051585
§ 371 (c)(1),
(2) Date: Jan. 10, 2020

(87) PCT Pub. No.: WO2019/055018
PCT Pub. Date: Mar. 21, 2019

(65) Prior Publication Data
US 2020/0207095 A1 Jul. 2, 2020

(51) Int. Cl.
*B41J 2/165* (2006.01)

(52) U.S. Cl.
CPC ..... *B41J 2/16535* (2013.01)

(58) Field of Classification Search
CPC .... B41J 2/16541; B41J 2/165; B41J 2/16538; B41J 2/16535; B41J 2/16517
See application file for complete search history.

(56) References Cited

U.S. PATENT DOCUMENTS

| | | | | |
|---|---|---|---|---|
| 3,202,372 | A | 8/1965 | Meline et al. | |
| 4,795,347 | A | 1/1989 | Maurer | |
| 6,065,174 | A | 5/2000 | Laymon | |
| 6,543,893 | B2 | 4/2003 | Desormeaux | |
| 6,793,318 | B2 | 9/2004 | Saksa | |
| 6,899,420 | B2 | 5/2005 | Silverbrook | |
| 7,465,013 | B2 | 12/2008 | Siiverbrook et al. | |
| 7,758,038 | B2 | 7/2010 | Siiverbrook et al. | |
| 8,579,410 | B1 | 11/2013 | Simmons | |
| 8,636,338 | B2 | 1/2014 | Mealy et al. | |
| 2003/0081042 | A1* | 5/2003 | Wotton | B41J 2/16547 347/22 |
| 2009/0179940 | A1* | 7/2009 | Hibbard | B41J 2/16585 347/31 |

FOREIGN PATENT DOCUMENTS

WO WO-2017100149 6/2017

OTHER PUBLICATIONS

One Printhead, Many Industries, 2009, < https://www.memjet.com/technology/printhead >.

* cited by examiner

*Primary Examiner* — Jannelle M Lebron
(74) *Attorney, Agent, or Firm* — Dicke Billig & Czaja PLLC

(57) ABSTRACT

A fluid ejection device includes a fluid ejection assembly including a fluid ejection die, and a service assembly to be rotated to different positions relative to the fluid ejection assembly for different service operations of the fluid ejection die.

15 Claims, 11 Drawing Sheets

ROTATABLE SERVICE ASSEMBLY FOR FLUID EJECTION DIE

BACKGROUND

A fluid ejection die, such as a printhead die in an inkjet printing system, may use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead die and the print medium move relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
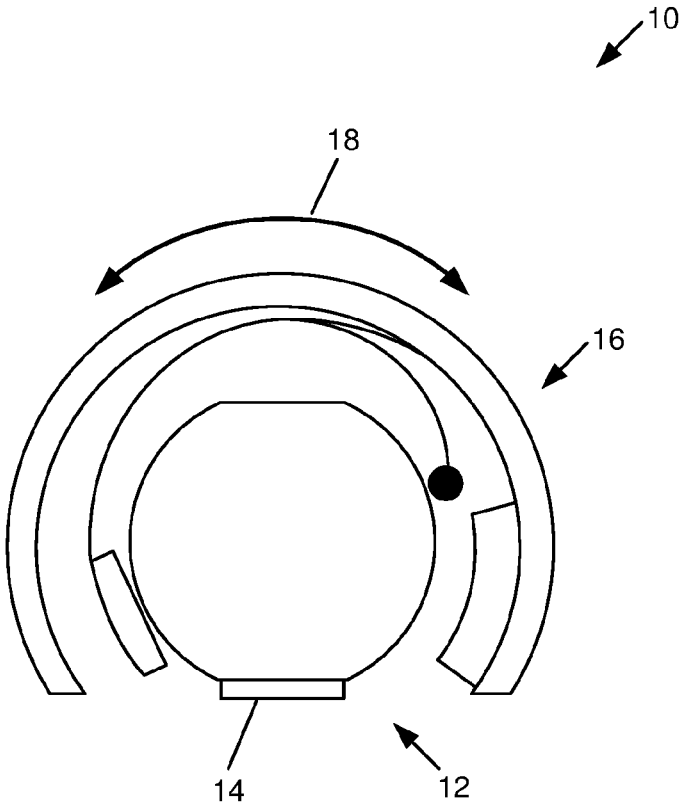
FIG. 1 is a schematic view illustrating an example of a fluid ejection device.

As illustrated in the example of FIG. 1, the present disclosure provides a fluid ejection device 10. In one implementation, the fluid ejection device includes a fluid ejection assembly 12 including a fluid ejection die 14, and a service assembly 16 to be rotated to different positions relative to the fluid ejection assembly, as represented, for example, by arrow 18, for different service operations of the fluid ejection die, such as capping, wiping, and/or purging.

Figure 2:
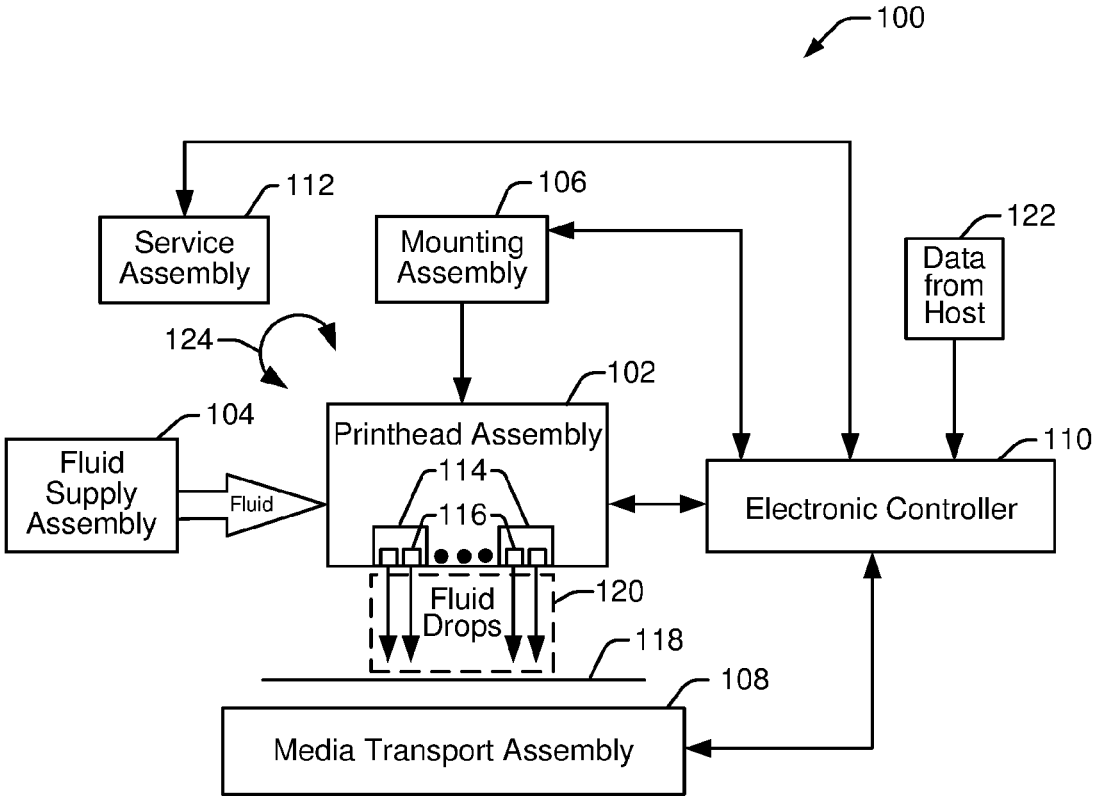
FIG. 2 is a block diagram illustrating an example of an inkjet printing system including an example of a fluid ejection device.

FIG. 2 illustrates an example of an inkjet printing system including an example of a fluid ejection device, as disclosed herein. Inkjet printing system 100 includes a printhead assembly 102, as an example of a fluid ejection assembly, a fluid (ink) supply assembly 104, a mounting assembly 106, a media transport assembly 108, an electronic controller 110, and a service assembly 112.

Printhead assembly 102 includes at least one printhead die 114, as an example of a fluid ejection die, that ejects drops of fluid (ink) through a plurality of orifices or nozzles 116 toward a print medium 118 so as to print on print media 118. Nozzles 116 are typically arranged in one or more columns or arrays such that properly sequenced ejection of fluid (ink) from nozzles 116 causes characters, symbols, and/or other graphics or images to be printed on print media 118 as printhead assembly 102 and print media 118 are moved relative to each other. Print media 118 can be any type of suitable sheet or roll material, such as paper, card stock, transparencies, Mylar, and the like, and may include rigid or semi-rigid material, such as cardboard or other panels.

Fluid (ink) supply assembly 104 supplies fluid (ink) to printhead assembly 102 such that fluid flows from fluid (ink) supply assembly 104 to printhead assembly 102. In one example, printhead assembly 102 and fluid (ink) supply assembly 104 are housed together in an inkjet cartridge or pen. In another example, fluid (ink) supply assembly 104 is separate from printhead assembly 102 and supplies fluid (ink) to printhead assembly 102 through an interface connection, such as a supply tube. In either example, fluid (ink) supply assembly 104 may be removed, replaced, and/or refilled.

Mounting assembly 106 positions printhead assembly 102 relative to media transport assembly 108, and media transport assembly 108 positions print media 118 relative to printhead assembly 102. Thus, a print zone 120 is defined adjacent to nozzles 116 in an area between printhead assembly 102 and print media 118. In one example, printhead assembly 102 is a scanning type printhead assembly. As such, mounting assembly 106 includes a carriage for moving printhead assembly 102 relative to media transport assembly 108 to scan print media 118. In another example, printhead assembly 102 is a non-scanning type printhead assembly. As such, mounting assembly 106 fixes printhead assembly 102 at a prescribed position relative to media transport assembly 108.

Electronic controller 110 typically includes a processor, firmware, software, one or more memory components including volatile and non-volatile memory components, and other printer electronics for communicating with and controlling printhead assembly 102, mounting assembly 106, media transport assembly 108, and service assembly 112. Electronic controller 110 receives data 122 from a host system, such as a computer, and temporarily stores data 122 in a memory. Data 122 may be received via an electronic, infrared, optical, or other information transfer path. Data 122 represents, for example, a document and/or file to be printed. As such, data 122 forms a print job for inkjet printing system 100 and includes one or more print job commands and/or command parameters.

In one example, electronic controller 110 controls printhead assembly 102 for ejection of fluid (ink) drops from nozzles 116. Thus, electronic controller 110 defines a pattern of ejected fluid (ink) drops which form characters, symbols, and/or other graphics or images on print media 118. The pattern of ejected fluid (ink) drops is determined by the print job commands and/or command parameters.

Service assembly 112 provides for wiping, capping, spitting, and/or priming of printhead assembly 102 in order to maintain a functionality of printhead assembly 102, including, more specifically, nozzles 116 of printhead die 114. For example, service assembly 112 may include a rubber blade or wiper which periodically contacts and passes over printhead assembly 102 to wipe and clean nozzles 116 of excess ink. In addition, service assembly 112 may include a cap which covers printhead assembly 102 to protect nozzles 116 from drying out during periods of non-use. In addition, service assembly 112 may include a spittoon or absorbent material into which printhead assembly 102 ejects (i.e., spits or purges) ink to insure that fluid (ink) supply assembly 104 maintains an appropriate level of pressure and fluidity, and insure that nozzles 116 do not clog or weep. Functions of service assembly 112 may include relative motion between service assembly 112 and printhead assembly 102. In one implementation, service assembly 112 is rotatable relative to printhead assembly 102, as represented, for example, by arrow 124, to provide different service operations for printhead assembly 102, including, more specifically, printhead die 114 of printhead assembly 102.

Printhead assembly 102 includes one (i.e., a single) printhead die 114 or more than one (i.e., multiple) printhead die 114. In one example, printhead assembly 102 is a wide-array or multi-head printhead assembly. In one implementation of a wide-array assembly, printhead assembly 102 includes a carrier that carries a plurality of printhead dies 114, provides electrical communication between printhead dies 114 and electronic controller 110, and provides fluidic communication between printhead dies 114 and fluid (ink) supply assembly 104.

In one example, inkjet printing system 100 is a drop-on-demand thermal inkjet printing system wherein printhead assembly 102 includes a thermal inkjet (TIJ) printhead that implements a thermal resistor as a drop ejecting element to vaporize fluid (ink) in a fluid chamber and create bubbles that force fluid (ink) drops out of nozzles 116. In another example, inkjet printing system 100 is a drop-on-demand piezoelectric inkjet printing system wherein printhead assembly 102 includes a piezoelectric inkjet (PIJ) printhead that implements a piezoelectric actuator as a drop ejecting element to generate pressure pulses that force fluid (ink) drops out of nozzles 116.

Figure 3:
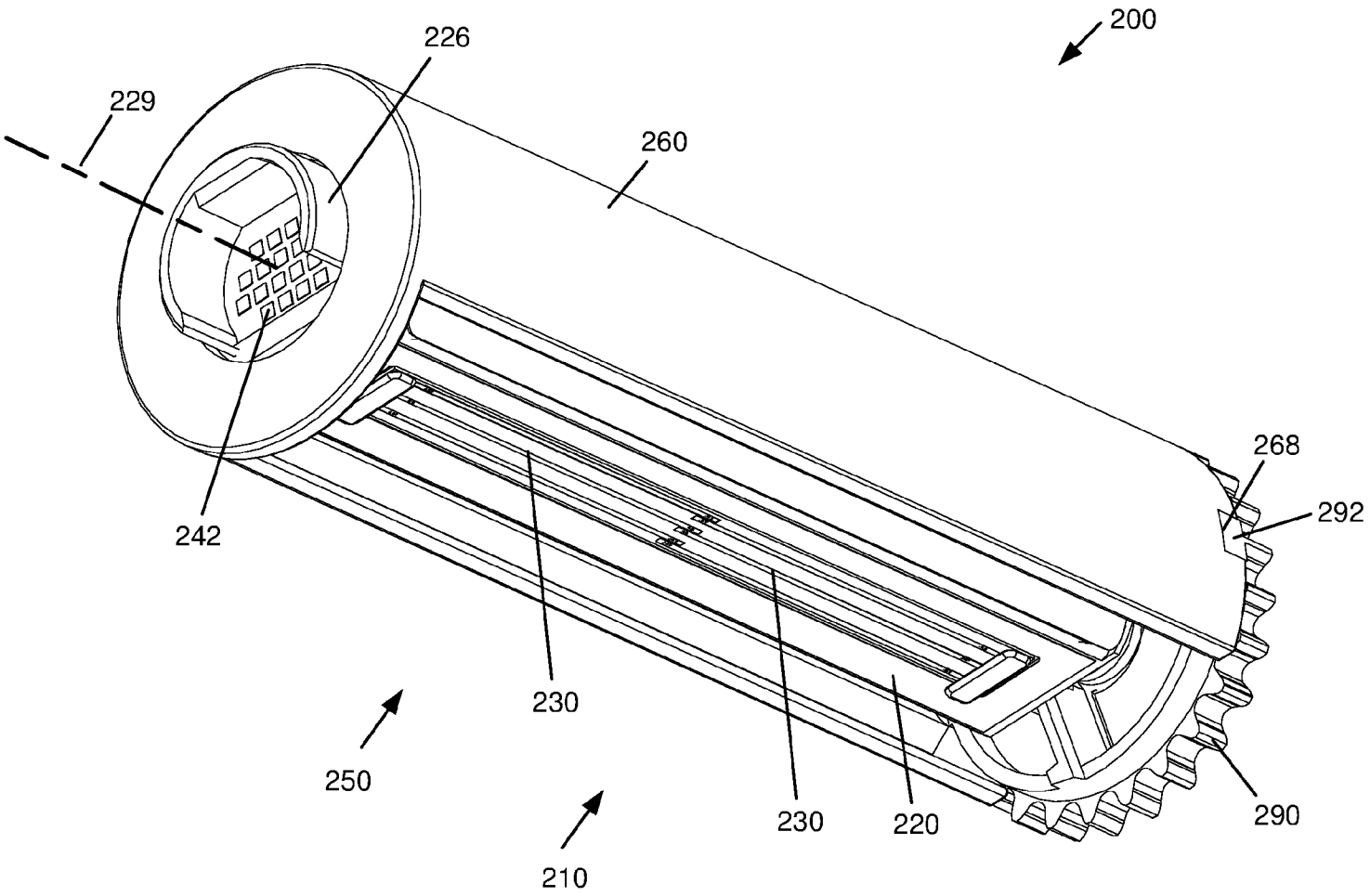
FIG. 3 is a perspective view illustrating an example of a fluid ejection device including an example of a fluid ejection assembly and an example of a service assembly for the fluid ejection assembly.
Figure 4:
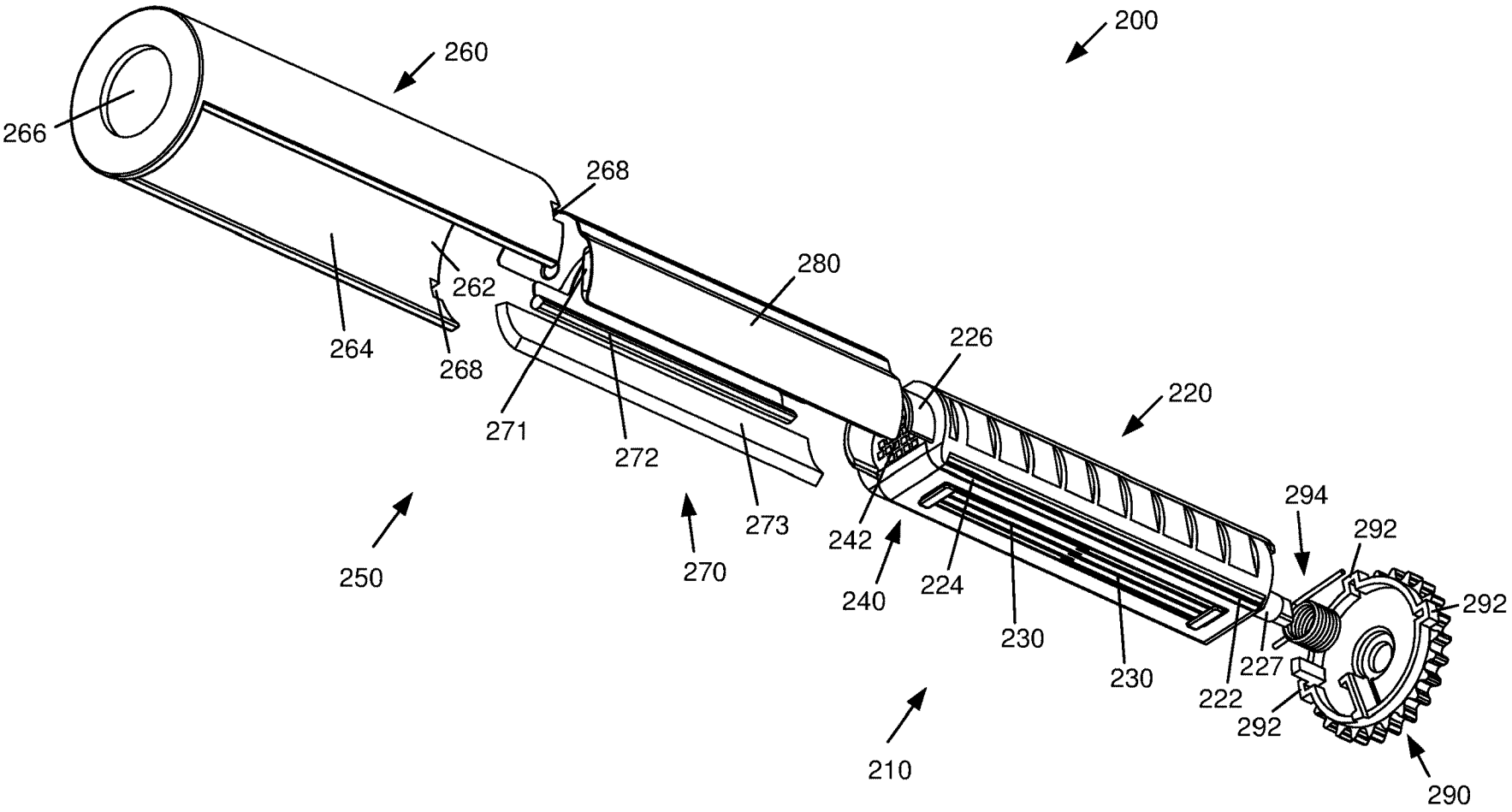
FIG. 4 is an exploded perspective view illustrating an example of the fluid ejection device of FIG. 3.

FIG. 3 is a perspective view illustrating an example of a fluid ejection device 200 in accordance with the present disclosure, and FIG. 4 is an exploded perspective view illustrating an example of fluid ejection device 200. In the illustrated example, fluid ejection device 200 includes a fluid ejection assembly 210, as an example of printhead assembly 102 (FIG. 2), and a service assembly 250, as an example of service assembly 112 (FIG. 2). As disclosed herein, service assembly 250 is rotated to different positions relative to fluid ejection assembly 210 for different service operations of fluid ejection assembly 210.

In one example, fluid ejection assembly 210 includes a housing or body 220, a fluid ejection die 230, and an electrical circuit 240 such that fluid ejection die 230 is supported by body 220 and electrically coupled with electrical circuit 240. In one implementation, fluid ejection die 230, as an example of printhead die 114 (FIG. 2), includes a drop-on-demand thermal inkjet (TIJ) printhead, as described above. In another implementation, fluid ejection die 230, as an example of printhead die 114 (FIG. 2), includes a drop-on-demand piezoelectric inkjet (PIJ) printhead, as described above. In either example, fluid ejection die 230 includes orifices or nozzles, such as orifices or nozzles 116 (FIG. 2), through which drops of fluid (ink) are ejected, as described above. In one example, fluid ejection die 230 includes a thin-film structure formed on a substrate with the substrate formed, for example, of silicon, glass, or a stable polymer, and the thin-film structure including conductive, passivation or insulation layers.

In one example, fluid ejection die 230 may be supplied with more than one type or color of fluid (e.g., fluids of different dyes, pigments, constituents, substances, agents, reactants, reagents, or colors) and may include a column (or columns) of orifices or nozzles for each type or color of fluid. In some examples, fluid ejection die 230 may eject different colors of fluid (e.g., cyan, magenta, yellow, and black ink). In other examples, fluid ejection die 230 may eject at least two types of fluid. For example, fluid ejection die 230 may correspond to a lab-on-a-chip device, where a first fluid may be a reagent, and a second fluid may be a solution including test material therein.

In one example, body 220 supports fluid ejection die 230 and includes a reservoir of fluid, such as fluid supply assembly 104 (FIG. 2), which communicates with and supplies fluid (ink) to fluid ejection die 230. In addition, body 220 supports electrical circuit 240 which facilitates communication of electrical signals between an electronic controller, such as electronic controller 110 (FIG. 2), and fluid ejection die 230 for controlling and/or monitoring operation of fluid ejection die 230.

In one example, electrical circuit 240 includes a plurality of electrical contacts 242 and a plurality of conductive paths which extend between and provide electrical connection between electrical contacts 242 and fluid ejection die 230. Electrical contacts 242 provide points for electrical connection to fluid ejection assembly 210 and, more specifically, fluid ejection die 230. As such, electrical contacts 242 facilitate communication of power, ground, and/or data signals with fluid ejection die 230. In one implementation, electrical circuit 240 is supported by body 220 such that electrical contacts 242 are provided at end of body 220.

In one example, electrical circuit 240 is a flexible electrical circuit with conductive paths formed in or on a flexible base material. The flexible base material may include, for example, a polyimide or other flexible polymer material (e.g., polyester, poly-methyl-methacrylate), and the conductive paths may be formed of copper, gold, or other conductive material.

In one implementation, fluid ejection assembly 210 includes multiple fluid ejection die 230 supported by body 220 such that fluid ejection assembly 210 provides a wide-array (e.g., page-wide array) printhead assembly. As a wide-array or multi-head printhead assembly, the multiple fluid ejection die 230 of fluid ejection assembly 210 are arranged and aligned in one or more staggered or overlapping rows such that a fluid ejection die 230 in one row overlaps at least one fluid ejection die 230 in another row. As such, fluid ejection assembly 210 may span a nominal page width or a width shorter or longer than a nominal page width.

In the illustrated example, service assembly 250 includes a shell 260 and servicing components 270 supported by shell 260. In one implementation, servicing components 270 include a cap 271, a wiper 272, and an absorber 273. In one example, cap 271 is formed of a rubber material and sized to fit around a perimeter of fluid ejection die 230 such that cap 271 covers fluid ejection die 230 including, more specifically, a front face of fluid ejection die 230, to protect nozzles or orifices of fluid ejection die 230 from drying out during periods of non-use. In one example, wiper 272 includes an elastomer tip which is periodically contacted with and passed over fluid ejection die 230 including, more specifically, a front face of fluid ejection die 230, to wipe and clean orifices or nozzles of fluid ejection die 230 of excess fluid (ink). In one example, absorber 273 includes an absorbent material or pad into which fluid ejection die 230 ejects fluid (i.e., spits or purges drops of fluid) to maintain an appropriate level of fluid pressure and fluidity, and to help insure that orifices or nozzles of fluid ejection die 230 do not clog or weep.

In one example, shell 260 has an inner surface 262 with servicing components 270 supported by or from inner surface 262. For example, in one implementation, absorber 273 is mounted on or secured to inner surface 262. In addition, in one implementation, cap 271 and wiper 272 are mounted on or supported by a leaf spring 280 which is secured to and extended from inner surface 262.

Figure 5:
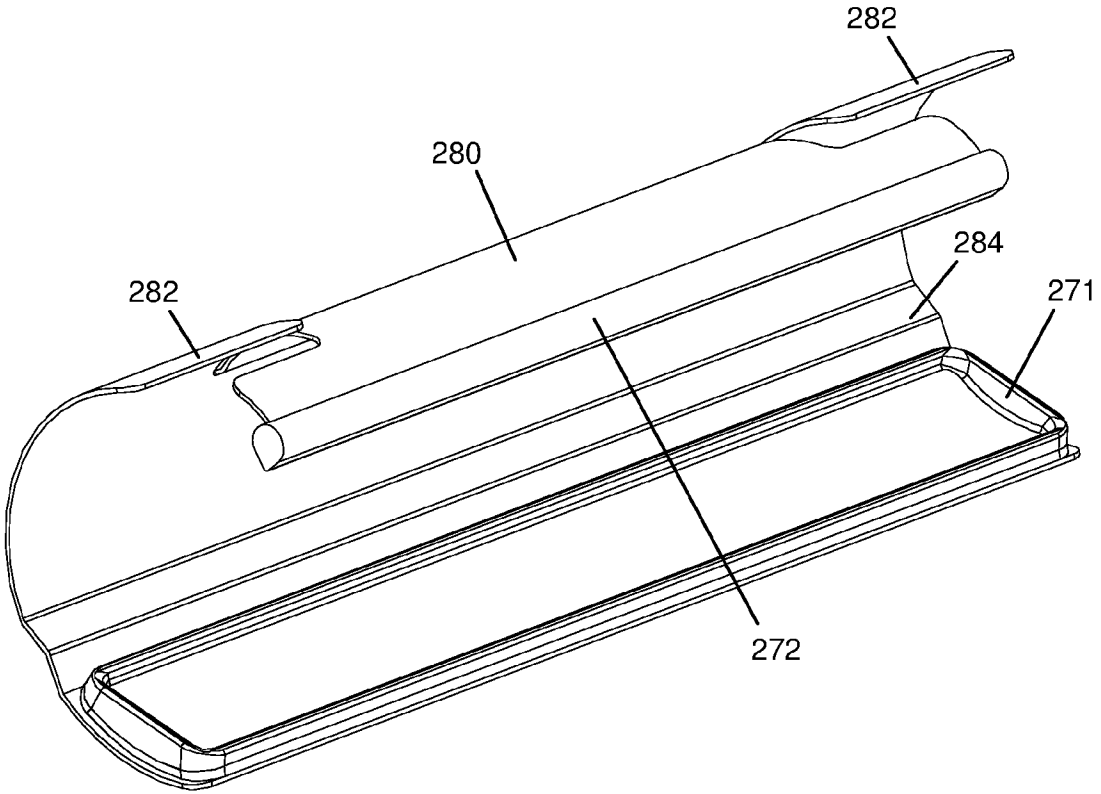
FIG. 5 is a perspective view illustrating an example of a portion of the service assembly of the fluid ejection device of FIGS. 3 and 4.

More specifically, in one implementation, as illustrated in the example of FIG. 5, wiper 272 is provided at an edge of leaf spring 280 along a length of leaf spring 280, and cap 271 is provided at an opposite edge of leaf spring 280 along a length of leaf spring 280. As such, and as described below, leaf spring 280 provides a biasing force to wiper 272 to wipe a front face of fluid ejection die 230, and provides a biasing force to cap 271 to cover a front face of fluid ejection die 230.

Figure 7:
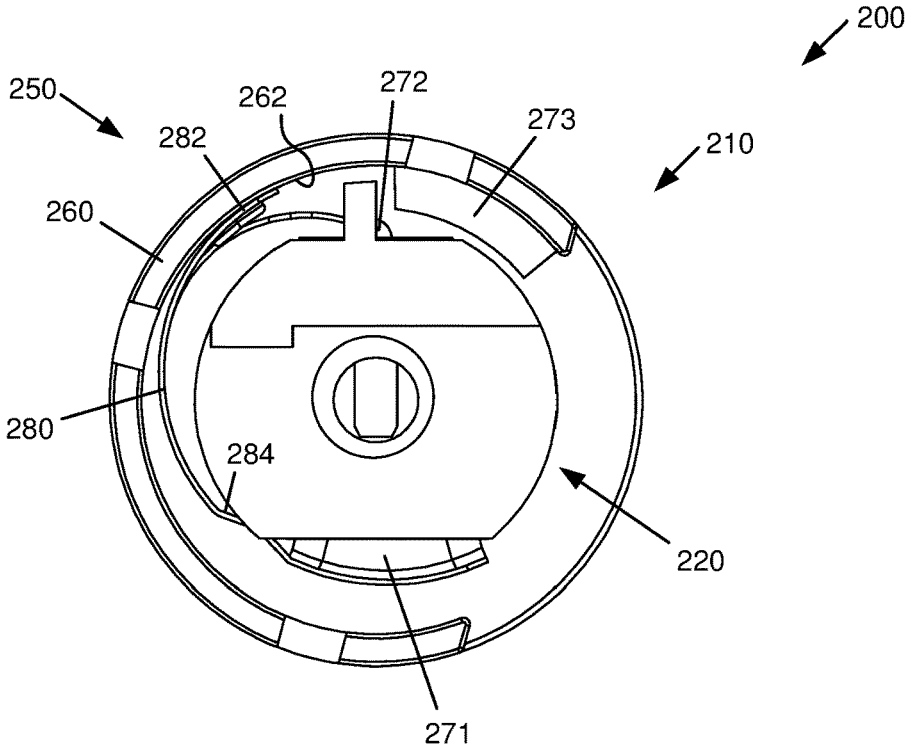
FIGS. 7 and 7*a* are end and end perspective views, respectively, illustrating an example of the service assembly of the fluid ejection device of FIGS. 3 and 4 in a position for service of the fluid ejection assembly.
Figure 7A:
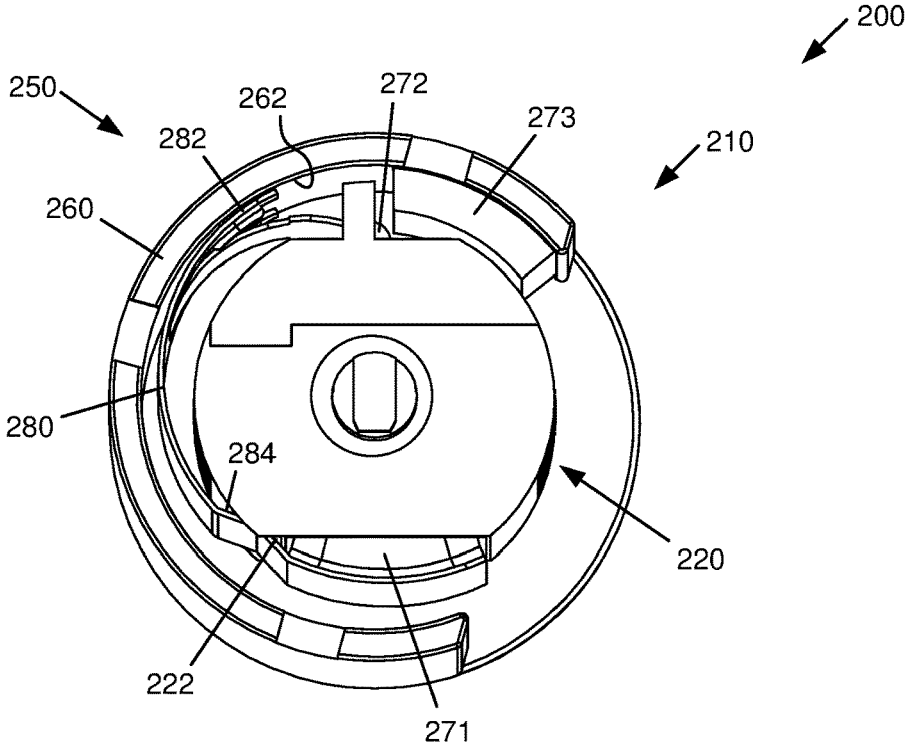

In one implementation, leaf spring 280 is a plate spring and includes portions or tabs 282 for securing leaf spring 280 to shell 260 including, more specifically, inner surface 262 of shell 260 (see, e.g., FIGS. 7, 7*a*). In one example, leaf spring 280 includes a ramped surface or feature 284 spaced from and extended substantially parallel with cap 271. In one implementation, ramped surface or feature 284 extends a length of leaf spring 280 along a length of cap 271. As such, ramped surface or feature 284 contacts body 220 to lift or space cap 271 relative to fluid ejection die 230 and help prevent cap 271 from sliding across a front face of fluid ejection die 230 as cap 271 is positioned over the front face of fluid ejection die 230. In one implementation, body 220 includes a corresponding recess or recessed feature 222 (FIG. 4, 9*a*) which receives ramped surface or feature 284 such that cap 271 may be sealed over the front face of fluid ejection die 230 when cap 271 is positioned over the front face of fluid ejection die 230 (see, e.g., FIGS. 7, 7*a*).

As illustrated in the example of FIGS. 3 and 4, body 220 of fluid ejection assembly 210 and shell 260 of service assembly 250 are generally cylindrical in shape. For example, body 220 has a cylindrical segment shape, and shell 260 has a cylindrical segment shape. More specifically, in one implementation, body 220 is of a truncated (horizontal) cylindrical segment shape and has a plane or flat surface 224 oriented parallel with a lengthwise (longitudinal) axis 229 of body 220 (see also, FIGS. 6, 8, 8*a*). In addition, shell 260 is of a truncated (horizontal) cylindrical segment shape and has an opening (i.e., longitudinal opening) 264 therein extended lengthwise of shell 260 (see also, FIGS. 8, 8*a*). As such, in one implementation, fluid ejection die 230 is provided on surface 224 of body 220 (with a column (or columns) of orifices or nozzles of fluid ejection die 230 oriented substantially parallel with axis 229) and shell 260 is supported about body 220 such that, in one rotational orientation of shell 260, fluid ejection die 230 is aligned with and exposed through opening 264 of shell 260 (see, e.g., FIGS. 8, 8*a*).

As illustrated in the example of FIGS. 3 and 4, shell 260, with leaf spring 280 and servicing components 270, is concentric with and rotatably supported about body 220 such that shell 260 is rotatable about axis 229 of body 220. For example, in one implementation, a shoulder 226 is provided at an end of body 220 and an opening 266 is provided in an end of shell 260 such that shoulder 226 is extended through opening 266 and shell 260 is rotatably supported about body 220 on shoulder 226. More specifically, as the column (or columns) of orifices or nozzles of fluid ejection die 230 are oriented substantially parallel with axis 229, and shell 260 is rotatable about axis 229, shell 260, with leaf spring 280 and servicing components 270, is rotatable relative to fluid ejection die 230 about an axis oriented substantially parallel with the column of orifices or nozzles. As such, shell 260, with leaf spring 280 and servicing components 270, is rotated to different positions relative to fluid ejection assembly 210 for different service operations of fluid ejection die 230, as described below.

In one implementation, shell 260, with leaf spring 280 and servicing components 270, is rotated by a drive sprocket 290. In one example, drive sprocket 290 is engaged and driven by, for example, a motor or another sprocket, gear, toothed shaft, or belt which is driven by a motor. In one example, shell 260 and drive sprocket 290 include corresponding and mating engagement features, such as corresponding and mating notches 268 and tabs 292, such that shell 260 is mated with and coupled for rotation with drive sprocket 290.

Figure 6:
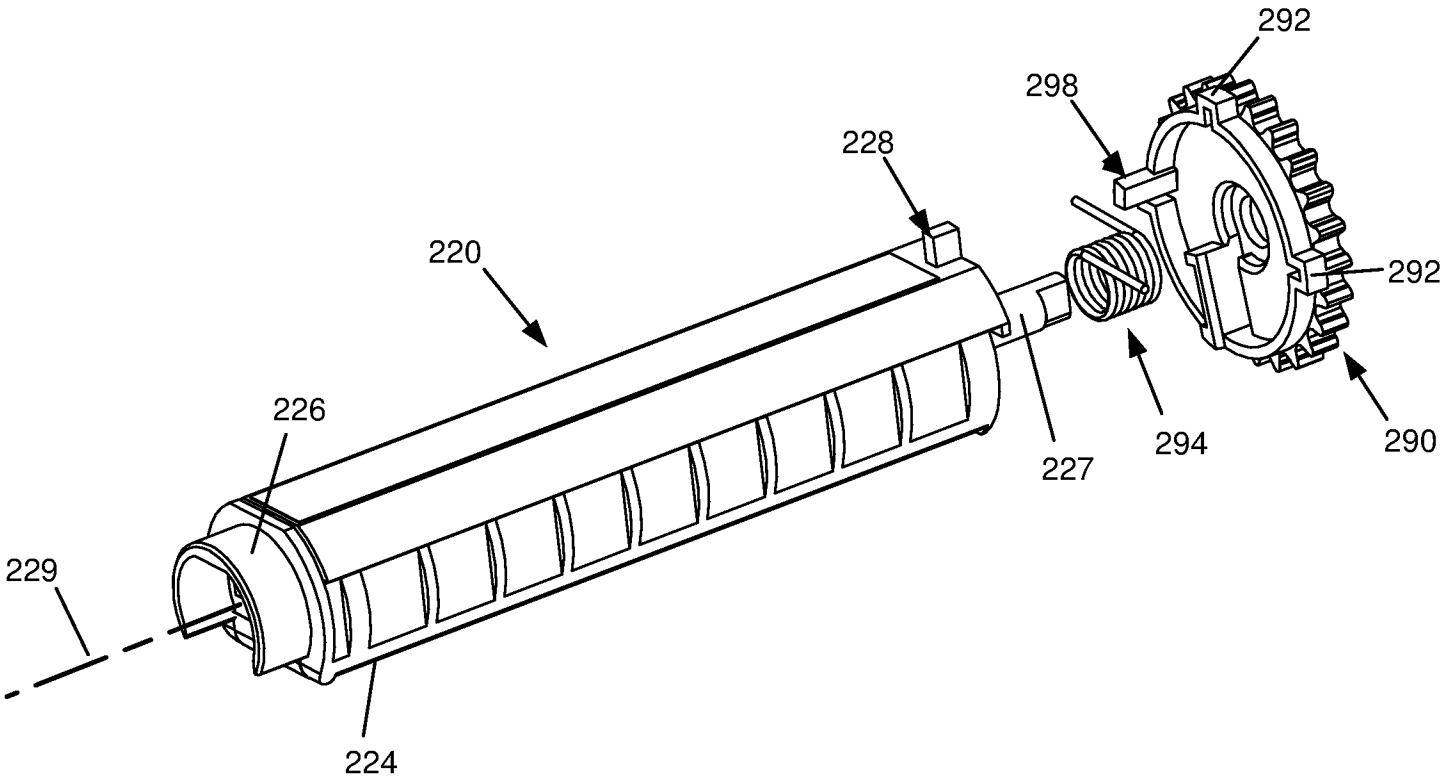
FIG. 6 is an exploded perspective view illustrating an example of a portion of the fluid ejection device of FIGS. 3 and 4.

In one implementation, as illustrated in FIG. 6, drive sprocket 290 and shell 260, with leaf spring 280 and servicing components 270, is biased, for example, by a torsion spring 294, to a default (rotational) position, as described below. In addition, in one example, drive sprocket 290 is rotatably mounted on a post 227 extended from an end of body 220. As such, shell 260, with leaf spring 280 and servicing components 270, is rotatably supported at one end by shoulder 226 of body 220 and rotatably supported at an opposite end by drive sprocket 290 which, in turn, is rotatably mounted on post 227 of body 220. Thus, shell 260, with leaf spring 280 and servicing components 270, is rotatably supported about and relative to body 220. In one implementation, drive sprocket 290 includes a rotation stop feature 298 which contacts a rotation stop feature 228 of body 220 to limit rotation of drive sprocket 290.

FIGS. 7 and 7*a* are end and end perspective views, respectively, illustrating an example of service assembly 250 of fluid ejection device 200 of FIGS. 3 and 4 in a position for service of fluid ejection assembly 210. More specifically, FIGS. 7 and 7*a* illustrate an example of service assembly 250 in a position to service fluid ejection die 230 with cap 271 and cover or cap fluid ejection die 230 (i.e., a capped position). As such, in the capped position, cap 271 covers fluid ejection die 230 to protect orifices or nozzles of fluid ejection die 230 from drying out during periods of non-use. In one implementation, service assembly 250 is biased to the capped position of FIGS. 7 and 7*a*, for example, by torsion spring 294, such that the capped position of FIGS. 7 and 7*a* represents a default (rotational) position of service assembly 250.

Figure 8:
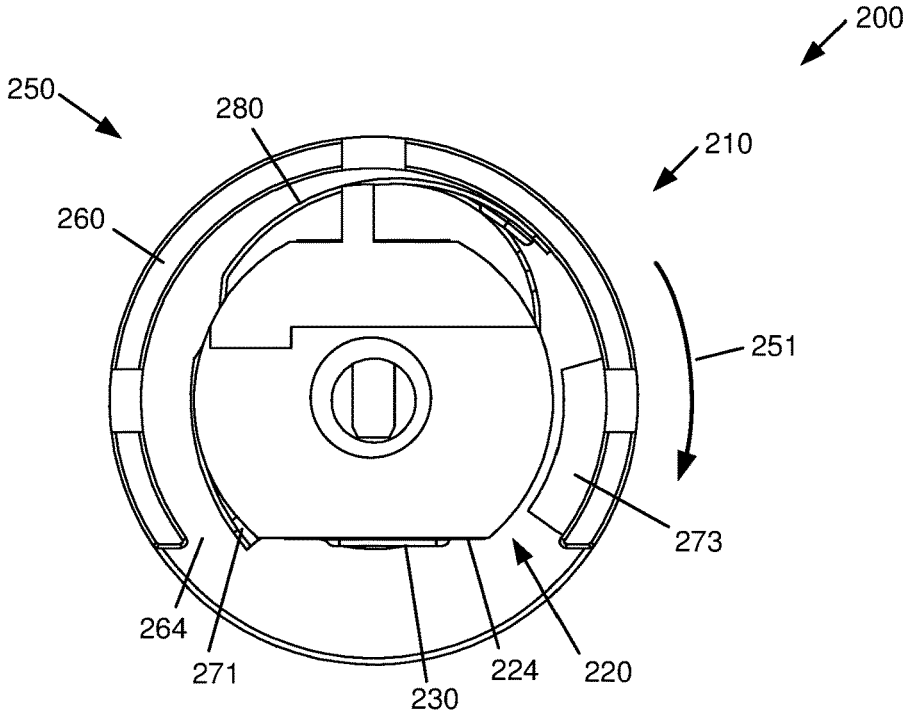
FIGS. 8 and 8*a* are end and end perspective views, respectively, illustrating an example of the service assembly of the fluid ejection device of FIGS. 3 and 4 in a position for fluid ejection by the fluid ejection assembly.
Figure 8A:
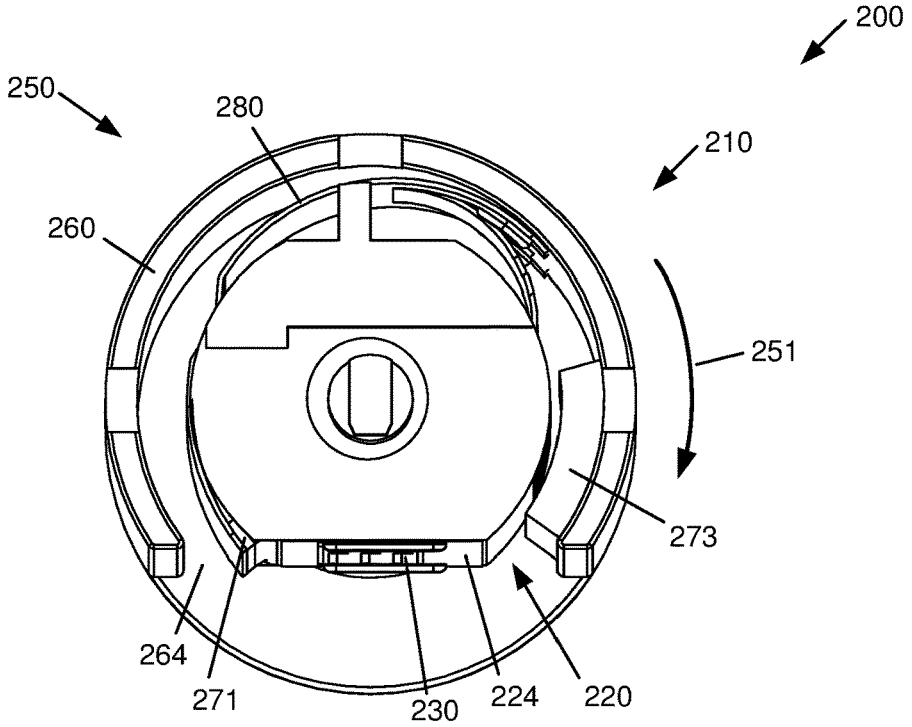

FIGS. 8 and 8*a* are end and end perspective views, respectively, illustrating an example of service assembly 250 of fluid ejection device 200 of FIGS. 3 and 4 in a position for fluid ejection by fluid ejection assembly 210. More specifically, FIGS. 8 and 8*a* illustrate an example of service assembly 250 in a position to allow ejection of fluid from fluid ejection die 230 (i.e., an ejection (or print) position). As such, in the ejection (or print) position, drops of fluid may be ejected from fluid ejection die 230. In one implementation, service assembly 250 is rotated (e.g., clockwise in the illustrated example as represented by arrow 251) to remove cap 271 from fluid ejection die 230 and establish the ejection (or print) position. Service assembly 250 is rotated, for example, by drive sprocket 290 (FIG. 3, 4).

Figure 9:
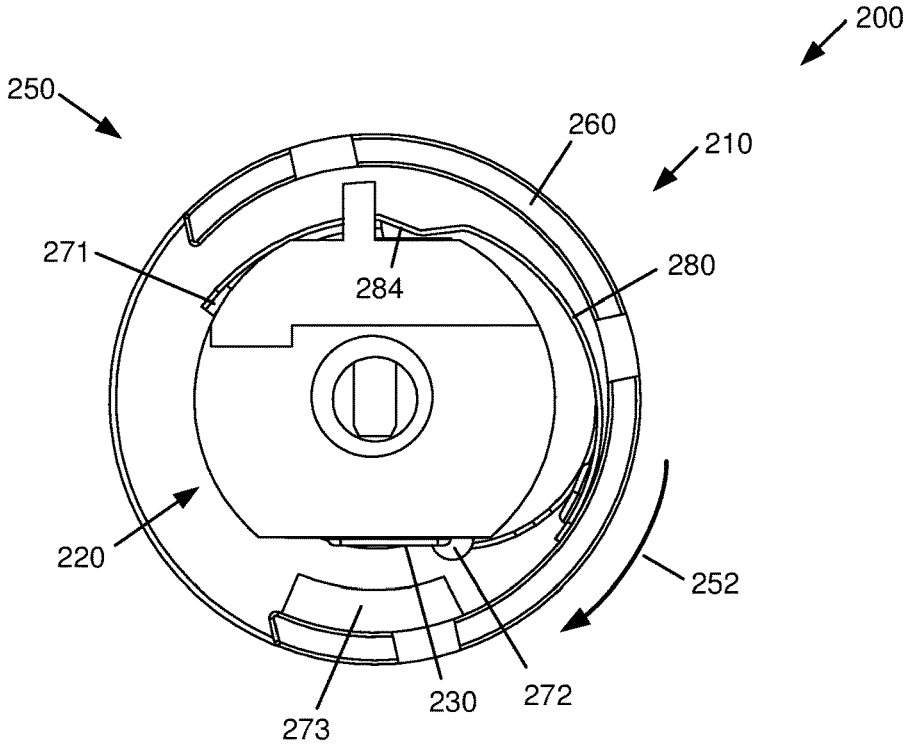
FIGS. 9 and 9*a* are end and end perspective views, respectively, illustrating an example of the service assembly of the fluid ejection device of FIGS. 3 and 4 in another position for service of the fluid ejection assembly.
Figure 9A:
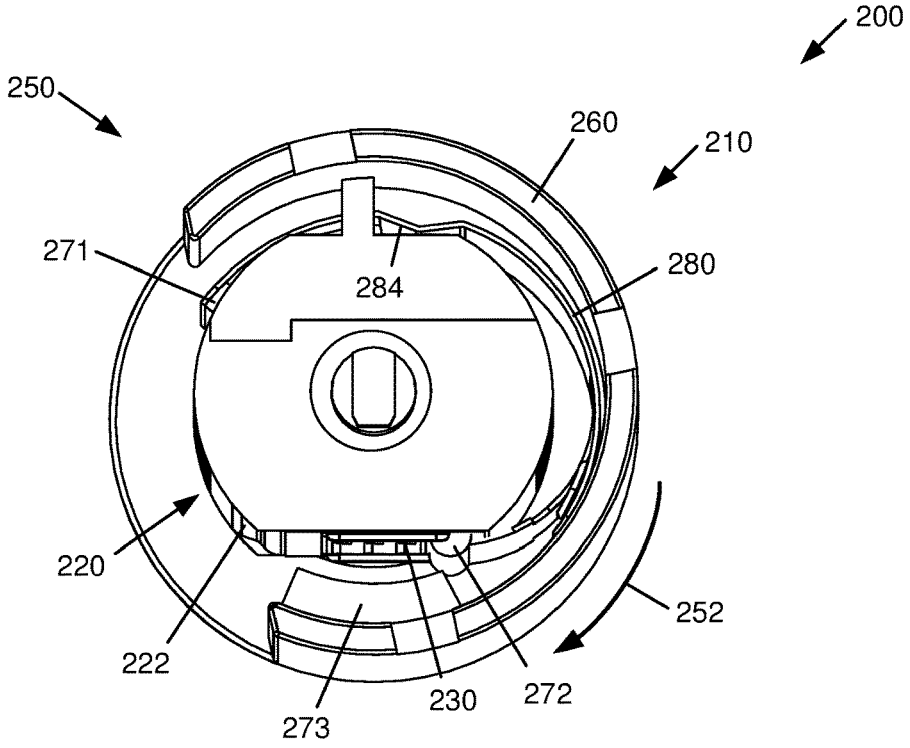

FIGS. 9 and 9*a* are end and end perspective views, respectively, illustrating an example of service assembly 250 of fluid ejection device 200 of FIGS. 3 and 4 in another position for service of fluid ejection assembly 210. More specifically, FIGS. 9 and 9*a* illustrate an example of service assembly 250 in a position to service fluid ejection die 230 with absorber 273 and receive fluid purged from fluid ejection die 230 (i.e., a spit position). As such, in the spit position, absorber 273 is positioned to receive drops of fluid ejected or purged from fluid ejection die 230. In one implementation, service assembly 250 is rotated (e.g., clockwise in the illustrated example as represented by arrow 252) to position absorber 273 opposite of fluid ejection die 230 and establish the spit position. Service assembly 250 is rotated, for example, by drive sprocket 290 (FIG. 3, 4).

Figure 10:
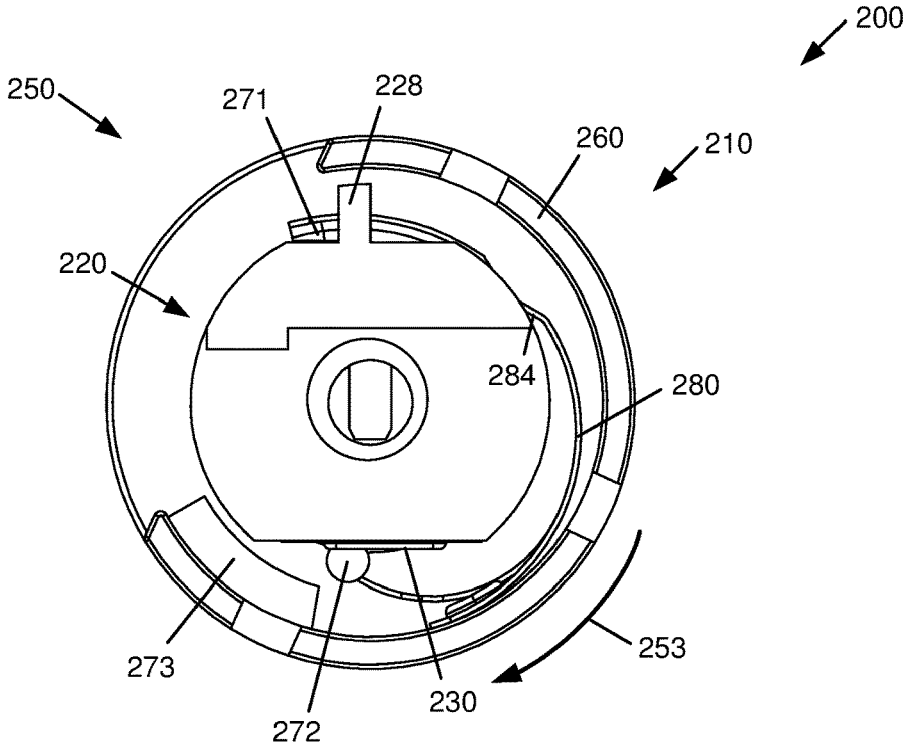
FIGS. 10 and 10*a* are end and end perspective views, respectively, illustrating an example of the service assembly of the fluid ejection device of FIGS. 3 and 4 in another position for service of the fluid ejection assembly.
Figure 10A:
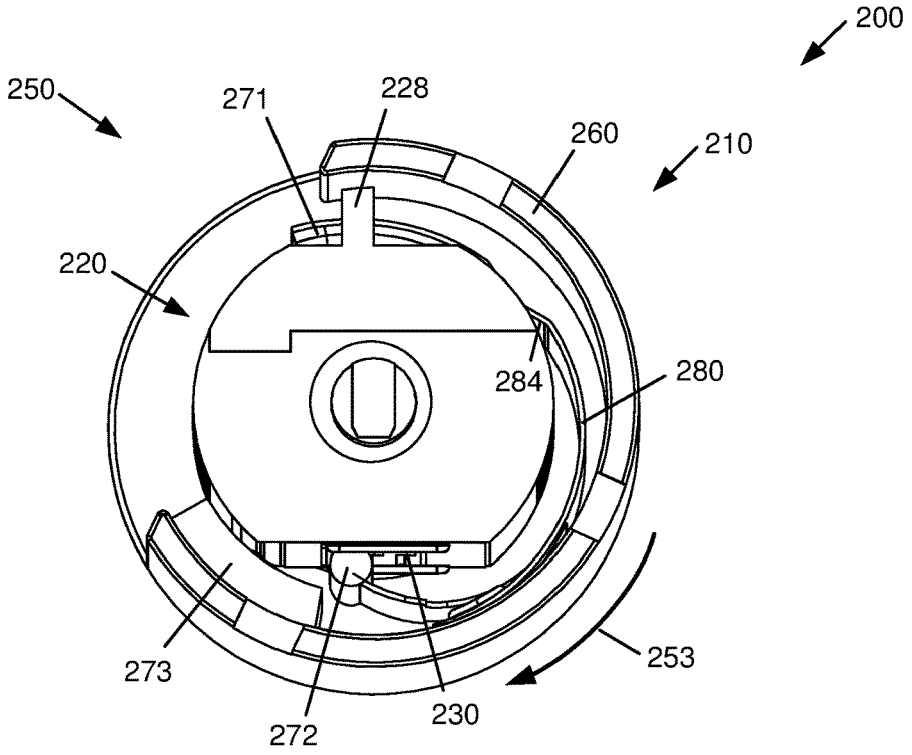

FIGS. 10 and 10*a* are end and end perspective views, respectively, illustrating an example of service assembly 250 of fluid ejection device 200 of FIGS. 3 and 4 in another position for service of fluid ejection assembly 210. More specifically, FIGS. 10 and 10*a* illustrate an example of service assembly 250 in a position to service fluid ejection die 230 with wiper 272 and wipe fluid ejection die 230 (i.e., a wipe position). As such, in and through the wipe position, wiper 272 contacts and passes over fluid ejection die 230 to wipe or clean orifices or nozzles of fluid ejection die 230. In one implementation, service assembly 250 is rotated (e.g., clockwise in the illustrated example as represented by arrow 253) to move wiper 272 across a front face of fluid ejection die 230 through and to establish the wipe position. Service assembly 250 is rotated, for example, by drive sprocket 290 (FIG. 3, 4).

In one implementation, an extent of rotation of service assembly 250 is limited, for example, by rotation stop features 228 and 298 of body 220 and drive sprocket 290, respectively (FIG. 6). In one implementation, after wiping of fluid ejection die 230, service assembly 250 is returned to the default position (e.g., the capped position of FIGS. 7 and 7*a*). Service assembly 250 is returned to the default position, for example, by torsion spring 294 (FIG. 6).

Figure 11:
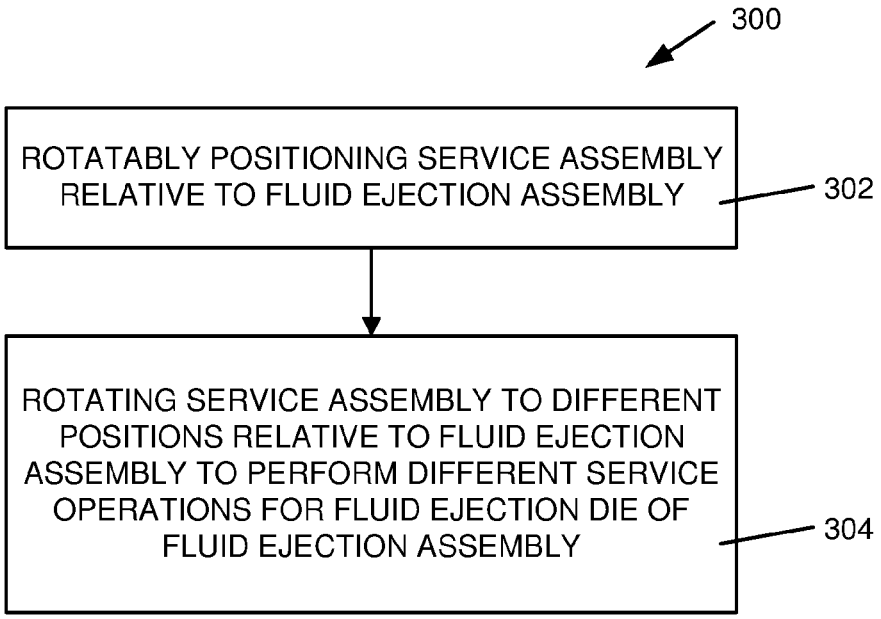
FIG. 11 is a flow diagram illustrating an example of a method of servicing a fluid ejection assembly.

FIG. 11 is a flow diagram illustrating an example of a method 300 of servicing a fluid ejection assembly, such as fluid ejection assembly 210 of fluid ejection device 200, as illustrated in the example of FIGS. 3, 4. At 302, method 300 includes rotatably positioning a service assembly relative to the fluid ejection assembly, such as rotatably positioning service assembly 250 relative to fluid ejection assembly 210, as illustrated in the example of FIGS. 3, 4. And, at 304, method 300 includes rotating the service assembly to different positions relative to the fluid ejection assembly to perform different service operations for a fluid ejection die of the fluid ejection assembly, such as rotating service assembly 250 to different positions relative to fluid ejection assembly 210 to perform different service operations for fluid ejection die 230 of fluid ejection assembly 210.

In one example, rotating the service assembly to different positions relative to the fluid ejection assembly to perform different service operations for a fluid ejection die of the fluid ejection assembly, at 304, includes rotating the service assembly to a position to cap the fluid ejection die, such as rotating service assembly 250 to the capped position of FIGS. 7 and 7*a*.

In one example, rotating the service assembly to different positions relative to the fluid ejection assembly to perform different service operations for a fluid ejection die of the fluid ejection assembly, at 304, includes rotating the service assembly to a position to receive drops of fluid purged from the fluid ejection die, such as rotating service assembly 250 to the spit position of FIGS. 9 and 9*a*.

In one example, rotating the service assembly to different positions relative to the fluid ejection assembly to perform different service operations for a fluid ejection die of the fluid ejection assembly, at 304, includes rotating the service assembly to a position to wipe the fluid ejection die, such as rotating service assembly 250 to the wipe position of FIGS. 10 and 10*a*.

By providing fluid ejection assembly 210 and service assembly 250 each with a cylindrical segment shape, and concentrically and rotatably supporting service assembly 250 about fluid ejection assembly 210, as disclosed herein, an integrated fluid ejection device 200 with a compact or reduced form factor may be achieved. As such, fluid ejection device 200, as disclosed herein, may be implemented, for example, in a pocket-sized printer.

Example fluid ejection devices, as described herein, may be implemented in printing devices, such as two-dimensional printers and/or three-dimensional printers (3D). As will be appreciated, some example fluid ejection devices may be printheads. In some examples, a fluid ejection device may be implemented into a printing device and may be utilized to print content onto a media, such as paper, a layer of powder-based build material, reactive devices (such as lab-on-a-chip devices), etc. Example fluid ejection devices include ink-based ejection devices, digital titration devices, 3D printing devices, pharmaceutical dispensation devices, lab-on-chip devices, fluidic diagnostic circuits, and/or other such devices in which amounts of fluids may be dispensed/ejected.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. A fluid ejection device, comprising:

a fluid ejection assembly including a body and a fluid ejection die provided on the body; and a service assembly concentric with and to be rotated about the body to different positions relative to the fluid ejection assembly for different service operations of the fluid ejection die.

2. The fluid ejection device of claim 1, the service assembly to be rotated to a first position relative to the fluid ejection assembly to cap the fluid ejection die.

3. The fluid ejection device of claim 2, the service assembly to be rotated to a second position relative to the fluid ejection assembly to wipe the fluid ejection die.

4. The fluid ejection device of claim 3, the service assembly to be rotated to a third position relative to the fluid ejection assembly to receive drops of fluid purged from the fluid ejection die.

5. The fluid ejection device of claim 1, the service assembly to be rotated relative to the fluid ejection assembly for ejection of fluid from the fluid ejection die.

6. The fluid ejection device of claim 1, the fluid ejection die including a column of fluid ejection orifices, and the service assembly to be rotated relative to the fluid ejection assembly about an axis oriented substantially parallel with the column of fluid ejection orifices.

7. A fluid ejection device, comprising:

a body having a cylindrical segment shape and a fluid ejection die provided on the body; and a shell concentric with and to be rotated about the body, the shell having a cylindrical segment shape and supporting at least one of a cap to cover the fluid ejection die, a wiper to wipe the fluid ejection die, and an absorber to receive drops of fluid purged from the fluid ejection die.

8. The fluid ejection device of claim 7, the shell rotatable relative to the body to service the fluid ejection die with the at least one of the cap, the wiper, and the absorber.

9. The fluid ejection device of claim 7, the shell having an opening therein extended lengthwise thereof, the fluid ejection die to eject drops of fluid through the opening.

10. The fluid ejection device of claim 7, the shell having an inner surface supporting the at least one of the cap, the wiper, and the absorber.

11. The fluid ejection device of claim 10, further comprising:

a leaf spring extending from the inner surface of the shell, the leaf spring supporting at least one of the cap and the wiper.

12. A method of servicing a fluid ejection assembly, comprising:

rotatably positioning a service assembly concentric with and relative to a body of the fluid ejection assembly; and rotating the service assembly about the body to different positions relative to the fluid ejection assembly to perform different service operations for a fluid ejection die provided on the body of the fluid ejection assembly.

13. The method of claim 12, wherein rotating the service assembly includes rotating the service assembly to a position to cap the fluid ejection die.

14. The method of claim 12, wherein rotating the service assembly includes rotating the service assembly to a position to wipe the fluid ejection die.

15. The method of claim 12, wherein rotating the service assembly includes rotating the service assembly to a position to receive drops of fluid purged from the fluid ejection die.

* * * * *